United States Patent [19]

Yokoi

[11] 4,175,748

[45] Nov. 27, 1979

[54] SHOOTING GAME DEVICE WITH PROJECTOR AND PHOTOELECTRIC DETECTOR

[75] Inventor: Gunpei Yokoi, Kyoto, Japan

[73] Assignee: Nintendo Co., Ltd., Kyoto, Japan

[21] Appl. No.: 855,607

[22] Filed: Nov. 29, 1977

[51] Int. Cl.[2] ..... F41G 3/26; F41J 5/02; F41J 9/14

[52] U.S. Cl. ..... 273/101.2; 273/105.1

[58] Field of Search ..... 273/101.1, 101.2, 105.1

[56] References Cited

U.S. PATENT DOCUMENTS

| | | | |
|---|---|---|---|
| 1,120,577 | 12/1914 | Wiese | 273/105.1 |
| 2,392,142 | 1/1946 | Gosswiller | 273/101.1 UX |
| 2,406,574 | 8/1946 | Waller et al. | 273/105.1 X |
| 2,442,240 | 5/1948 | Hooker et al. | 273/101.2 |
| 2,449,030 | 9/1948 | Wilsey | 273/105.1 |
| 3,802,099 | 4/1974 | Mell et al. | 35/25 |
| 3,904,204 | 9/1975 | Yokoi | 273/101.1 |
| 3,960,380 | 6/1976 | Yokoi | 273/101.1 |
| 3,964,178 | 6/1976 | Marshall et al. | 273/101.1 X |

*Primary Examiner*—Richard C. Pinkham
*Assistant Examiner*—Lawrence E. Anderson
*Attorney, Agent, or Firm*—Koda and Androlia

[57] ABSTRACT

A structure for a shooting game device of the type including the apparatus for projecting moving targets and hits onto a screen and a gun having a gun sight and in which when the gun sight corresponds with the projected moving target a hit is projected on the screen. The structure further includes a photoelectric element coupled to the gun such that it moves vertically and horizontally as the gun moves vertically and horizontally and apparatus for projecting a light mark in near proximity to the photoelectric element which is indicative of the position of a projected target. The photoelectric element and the apparatus for projecting a light mark being arranged and configured such that when the photoelectric element and the light mark coincide, the photoelectric element generates a hit signal which causes a hit to be projected on the screen in lieu of a target.

4 Claims, 10 Drawing Figures

SHOOTING GAME DEVICE WITH PROJECTOR AND PHOTOELECTRIC DETECTOR

BACKGROUND OF THE INVENTION

1. Field of Invention

The present invention relates to shooting game devices and more particularly to shooting game devices in which a moving target is projected onto a screen and in which when the gun site coincides with the target projected on the screen a hit is displayed.

2. Prior Art

Prior art shooting game devices include ones which employ a light emitting or light detecting type gun wherein a hit is detected when a light beam from a target enters a photoelectric element provided in the light detecting gun or a photoelectric element is disposed on screen. However, this type of device requires a gun with a complex structure and makes the device too costly for installation in general game rooms.

Another prior art device projects targets on a screen by means of one roll of film containing images depicting the appearance of a target and a second roll of film which contains images depicting scenes of the target's defeat when the target is hit and a means of switching between the two rolls of film. In the event the shooting is not successful, the switching between the two rolls of film does not take place and the first film moves on to show the victorious target leaving the scene and indicates to the shooter that he has failed to hit the target. Such a device requires complex control mechanisms for switching between the two rolls of film and makes the device costly. Again such devices are too costly for installation in general game rooms.

SUMMARY OF THE INVENTION

Accordingly it is the general object of the present invention to provide a simplified gun and hit detection mechanism for a shooting game device of the type including a screen to project moving targets upon.

It is another object of the present invention to provide a shooting game device with a simplified hit display mechanism.

It is another object of the present invention to provide a shooting game device which is low in cost.

In keeping with the principles of the present invention, the objects are accomplished by a unique structure for a shooting game device of the type including a means for projecting moving targets and hits onto a screen and a gun having a gun sight and in which when the gun sight corresponds with the projected moving target a hit is projected on the screen. The structure includes a photoelectric element coupled to the gun such that it moves vertically and horizontally as the gun moves vertically and horizontally and a means for projecting a light mark in near proximity to the photoelectric element which is indicative of the position of a projected target, the photoelectric element and the means for projecting a light mark being arranged in configuration such that the photoelectric element generates a hit signal which causes a hit to be projected onto the screen in lieu of a target whenever the photoelectric element and the light mark coincide.

BRIEF DESCRIPTION OF THE DRAWINGS

The above mentioned features and objects of the present invention will become more apparent with reference to the following descriptions taken in conjunction with the following drawings wherein like referenced numerals denote like elements and in which.

DETAILED DESCRIPTION OF THE INVENTION

Figure 1:
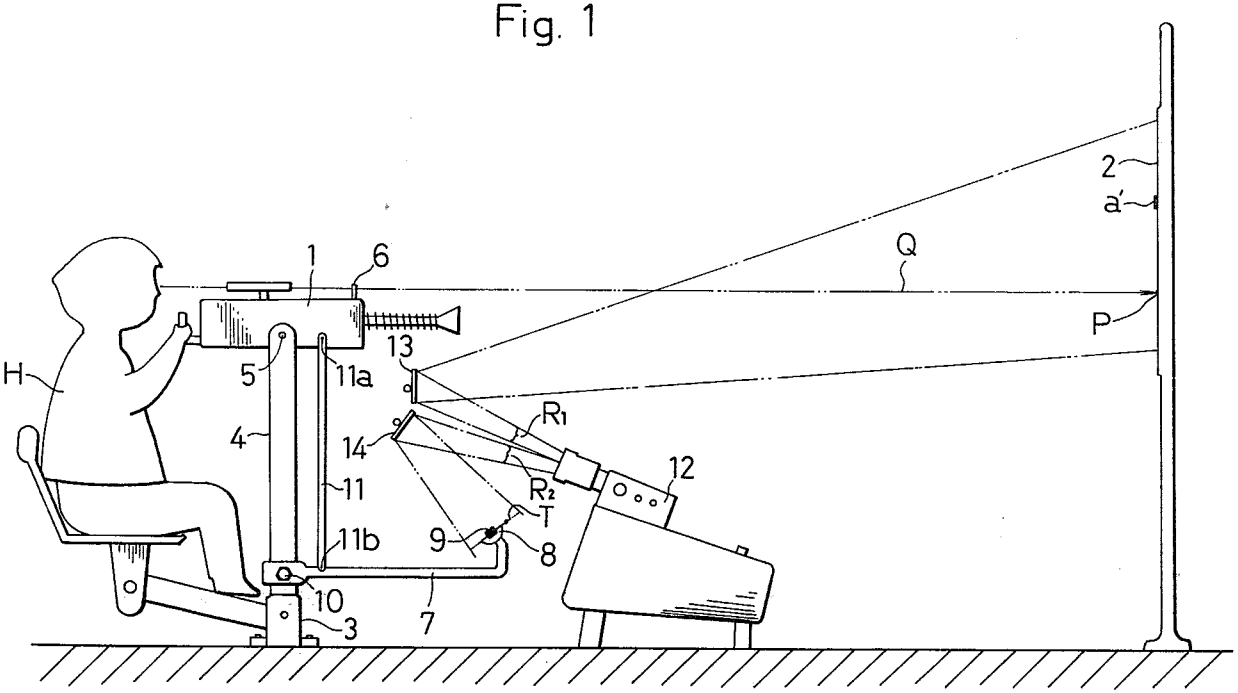
FIG. 1 is a side view illustrating a shooting game device in accordance with the teachings of the present invention.

Referring more particularly to the drawings, shown in FIG. 1 is a shooting game device in accordance with the teachings of the present invention. In FIG. 1 the shooting game device includes a machine gun type ray gun 1 facing a screen 2. The middle of the gun 1 is actually supported by a shaft 5 between a fork at the upper end of a support tube 4 which is rotatably coupled to a base 3. The gun 1 is therefore freely moveable in both the horizontal and vertical directions. Accordingly, the point of fire P, which is an extension Q from the gun sight 6 reaching the screen 2, moves in the X direction (horizontally on the screen) and in the Y direction (vertically on the screen) in accordance with the gun's horizontal and vertical movements.

A detector 8 with a photoelectric element 9 disposed therein is fixed to the tip of a detector frame 7. The base of the detector 7 is fixed to the lower end of the support tube 4 by means of a clamp 10 such that the frame 7 is moveable both vertically and horizontally in concurrence with the movement of the support tube 4. A connecting rod 11 is rotatably fixed to the gun 1 at the upper end 11*a* and to the detector frame 7 at the lower end 11*b* such that the detector 8 and thereby the photoelectric element 9 moves vertically as the gun moves vertically.

A projector 12 projects two beams of light. A first beam of light R1 is utilized to project various scenes depicting the target (for example an airplane) in flight, battle, victory march and the like. A second beam of light R2 is utilized to project scenes of defeat (for example an exploding target). The beams R1 and R2 are respectively reflected by first mirror 13 and a second mirror 14 and either projected on the screen or in near proximity to the photoelectric element 9.

Figure 2:
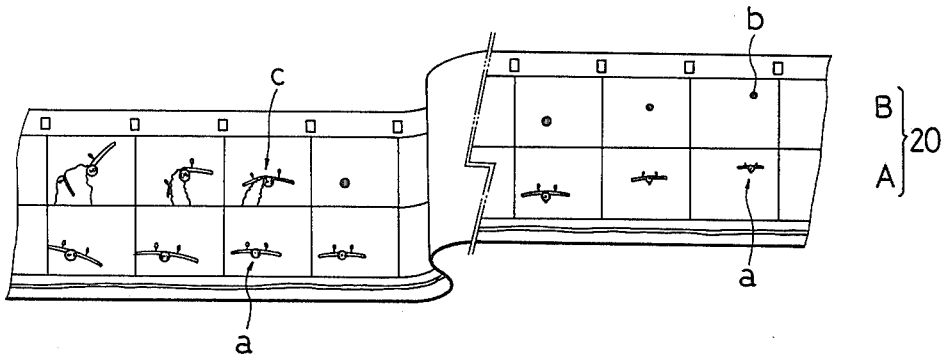
FIG. 2 illustrates the images on the film used in the shooting game device in accordance with the teachings of the present invention.

The projector 12 is loaded with film 20. As shown in FIG. 2, each frame of the film 20 is divided into a first tract A (lower half) containing an image for projecting a scene of a flying target a (for example the flight of an airplane, bird, etc., and its background) and a second track B (upper half) containing either a positioning signal mark (transparent spot) b at a location corresponding to the target a in the first track A or an image c showing a hit scene such as a plummeting or exploding target c. When the light R0 from the light source 21 passes through the lower half A of the film 20, the first beam of light R1 is projected and when the light R0 passes through the upper half B the second beam of light R2 is projected.

Figure 3:
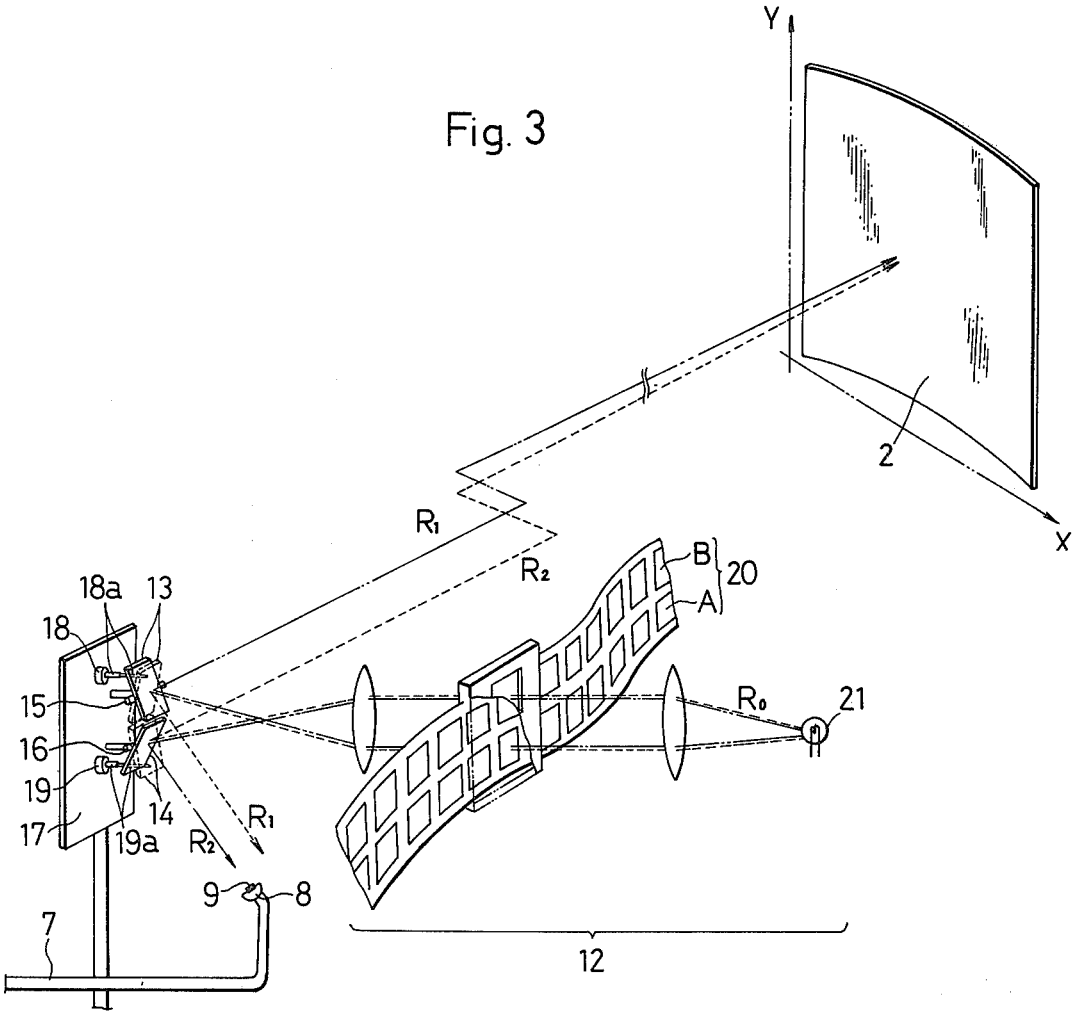
FIG. 3 illustrates the direction of the light beams and a light beam switching mechanism utilized in a shooting game device in accordance with the teachings of the present invention.

The first mirror 13 and the second mirror 14 are rotated to the positions as shown by the diamond lines in FIG. 3 such that the first beam R1 is reflected downward and thereby projected off the screen and the second beam R2 is reflected upward and onto the screen 2. In FIG. 3 the first mirror 13 is caused to move by means of a first solenoid 18 which is coupled to the top portion of the pivotally mounted first mirror 13 by way of a moveable piece 18*a*. The second mirror 14 which is pivotally mounted is caused to move by a second solenoid 19 which is coupled to the lower portion of the second mirror 14 by way of a moveable portion 19*a*. In this arrangement when the solenoids 18 and 19 are in their normal condition the first beam R1 is projected onto the screen and the second beam R2 is projected in near proximity to the detector 9.

In operation, when the projector 12 is activated the first beam R1 for displaying images on the lower half A of the film 20 and the second beam R2 for displaying images on the upper half B are projected from the projector 12 towards the first and second mirrors 13 and 14. The first beam R1 is reflected by the first mirror 13 and projected onto the screen 2 and thereby projects the target a (for example an airplane in flight and its background) onto the screen 2. While the second beam R2 is reflected by the second mirror 14 and projected towards the detector 8.

In this situation the shooter H moves the gun 1 vertically and horizontally in pursuit of the target a whose projected position is moving vertically and horizontally. At the same time the detector 8 is moving vertically and horizontally exactly in accordance with the gun's movement. The position of the photoelectric element 9 on the detector surface T moves in the X direction in proportion to the movement of the point of fire P in the X direction and in the Y direction in proportion to the movement of the point of fire P in the Y direction.

On the detector surface T the point where the light-emitting mark b is projected by the second beam R2 moves in the X direction as the target a. on the screen moves in the X direction and in the Y direction as the target moves in the Y direction.

Thus, on the screen when point P coincides with the target a. (i.e., a hit is made), the position of the light-emitting mark b. projected by the second beam R2 onto the detector surface T coincides with the position of the photoelectric element 9. As the beam from the light-emitting mark b. enters the photoelectric element 9, an output signal is generated by the photoelectric element 9 which is a hit signal.

The hit signal on the photoelectric element 9 goes through a control system such as amplifier, relay circuit, etc. and energizes the first solenoid 18 and the second solenoid 19 so that the moveable pieces 18*a* and 19*a* are pushed forward to change the tilting directions of the first mirror 13 and the second mirror 14 as shown by the broken lines in FIG. 3. The second beam R2 is then projected towards the screen 2 and the first beam R1 is projected downwardly. The hit scene c. will then be projected on the screen 2 to indicate a hit. After some appropriate time delay, the solenoids 18 and 19 are de-energized and the system returned to its normal condition.

In practice it should be apparent that the control circuit is made in accordance with prior art control circuits and is made from amplifier circuits, relay circuits, etc. which exists in the prior art. Furthermore, an appropriate delay circuit may be provided so as to activate the solenoids 18 and 19 just before the arrival of a hit scene c which is carried on the upper half B of the film 20.

Figure 4:
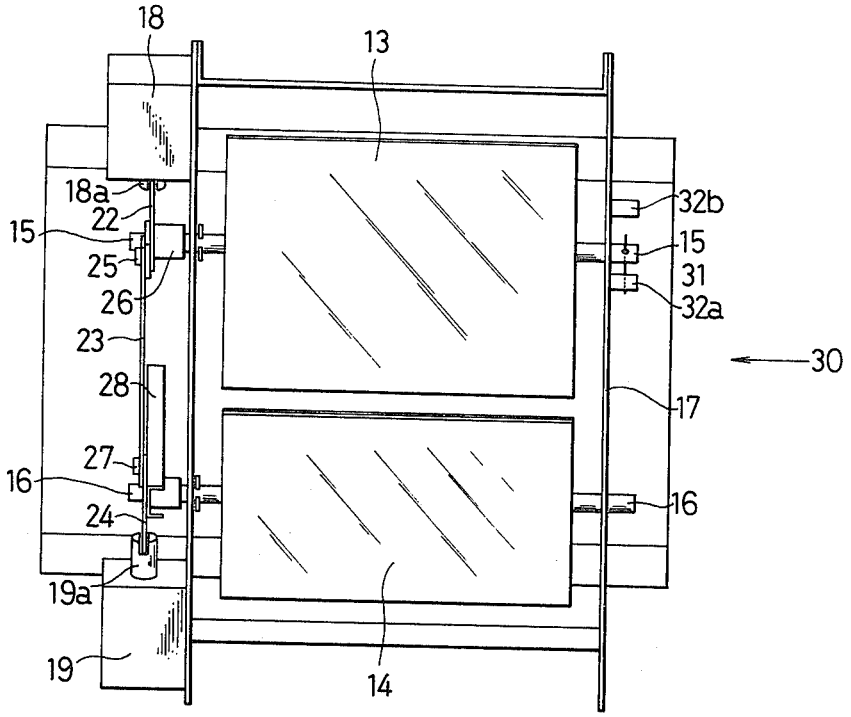
FIG. 4 is a plan view of a second embodiment of a switching mechanism for a shooting game device in accordance with the teachings of the present invention.
Figure 5:
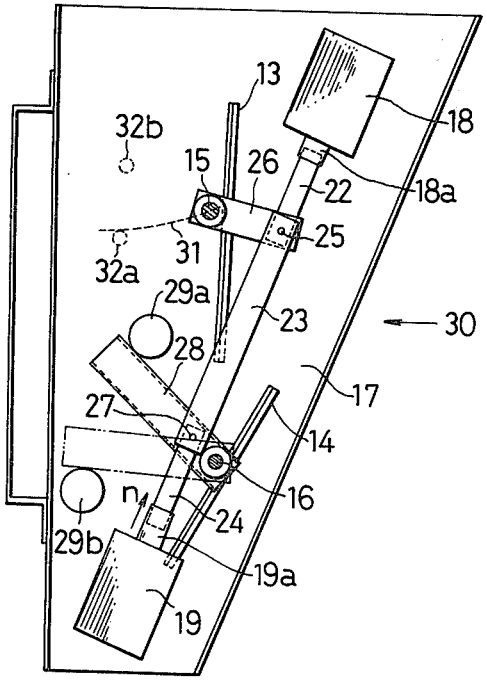
FIG. 5 is a side view of the switching mechanism in FIG. 4.
Figure 6:
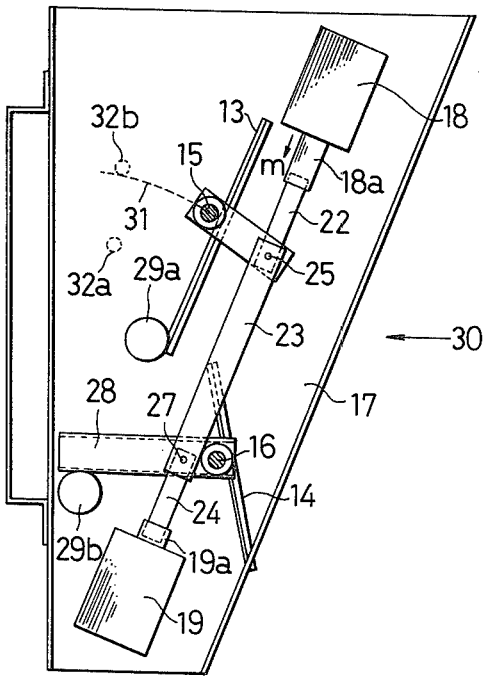
FIG. 6 is a side view of a switching mechanism of FIG. 4 when a hit is indicated.
Figure 7:
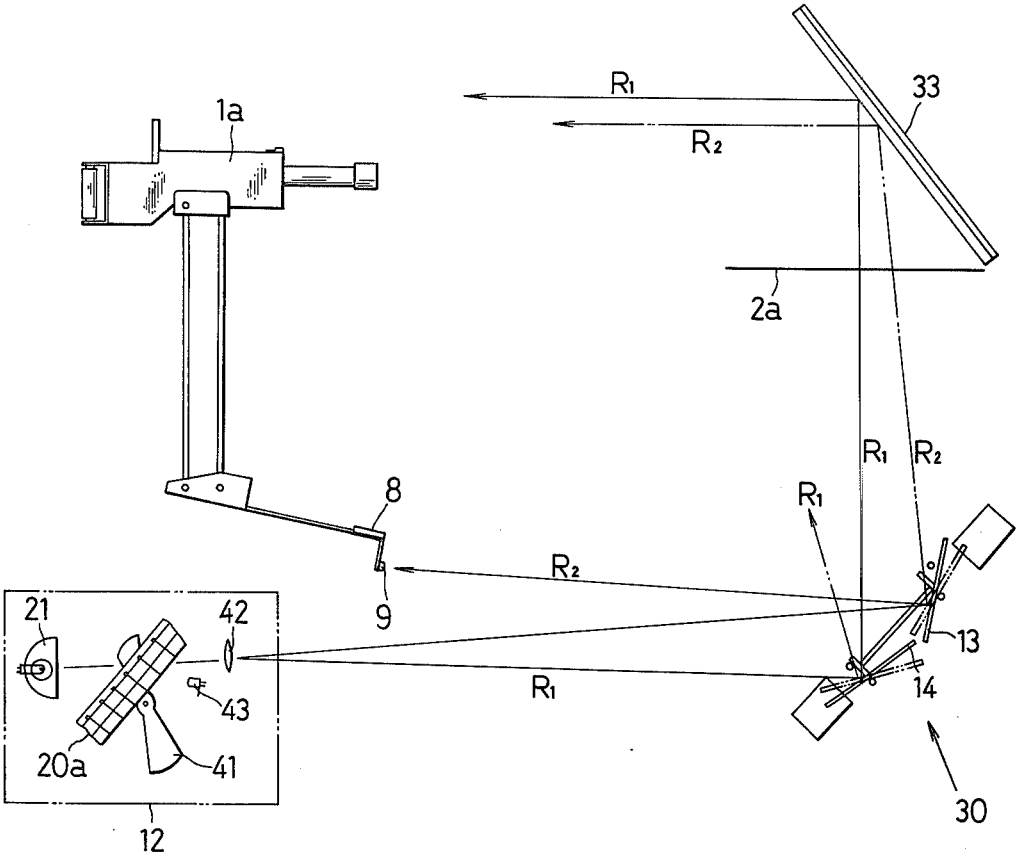
FIG. 7 illustrates a second embodiment of a shooting game device in accordance with the teachings of the present invention.

Referring to FIGS. 4 through 6, shown therein is a second embodiment of a switching mechanism 30 for varying the tilt angles of the mirrors 13 and 14. In this embodiment those elements which are the same as those of the previous embodiment are given like referenced numerals and a description of their inner-connections and operations will be omitted. This mechanism is different from that shown in FIG. 3 in that the moveable pieces 18*a* and 19*a* of the solenoids 18 and 19 move in opposing directions.

In FIGS. 4 through 6 the switching mechanism includes a first mirror 13 and a second mirror 14 rotatably coupled at their respective centers by shafts 15 and 16 to a holding plate 17 so as to be moveable vertically. By the electromagnetic action of the first solenoid 18 the moveable piece 18*a* is pushed out in the direction m. indicated by the arrow in FIG. 6 so as to rotate the first mirror 13 from an opposing position to a non-opposing position while the second mirror is rotated, by means of a connecting rod 23, from a non-opposing position to an opposing position (the hit indication position in FIG. 6). By the electromagnetic action of the second solenoid 19, the moveable piece 19*a* is pushed out in the direction n. indicated by the arrow in FIG. 5 so as to rotate the second mirror 14 from an opposing position to a non-opposing position while the first mirror 13 is rotated, by means of the connecting rod 23, from a non-opposing position to an opposing position. In this way, the first mirror 13 and the second mirror 14 are interlockingly reversed.

The moveable piece 18*a* of the first solenoid 18, a first moveable rod 22, the connecting rod 23 and a second moveable rod 24 are actually coupled together at their respective ends in series. The ends of the first moveable rod 22 and the connecting rod 23 are axially coupled by a pin 25 provided in rotatable plate 26. A shaft 15 rotatably holds the rotating plate 26, at the end of which is fixed first mirror 13. The ends of the second moveable piece 24 and the connecting rod 23 are coupled together by a pin 27 provided in rotatable plate 28. The plate 28 is rotatably held by shaft 16 and mirror 14 is fixed to the end of plate 28. One end of piano wire 31 is passed through shaft 15 and the other end is connected either to stopper pin 32*a* or to stopper pin 32*b* so as to improve the mobility of the moveable pieces 18*a* and 19*a* of the solenoids 18 and 19 and to enable the mirrors 13 and 14 to instantaneously switch from an opposing position to a non-opposing position or from a non-opposing position to an opposing position.

In operation, when a hit signal from the photoelectric element 9 passes through the control circuit to magnetize the first solenoid 18, it causes the moveable piece 18*a* to be pushed out as shown in FIG. 6 such that only the second mirror 14 is facing the screen 2. After a prescribed time lapse, while leaving the first solenoid 18 unmagnetized, the second solenoid 19 is magnetized so as to return the second mirror 14 to the position shown in FIG. 5.

Just as before if the target is not hit and therefore a hit signal from the photoelectric element 19 does not enter the control circuit, only the first beam R1 is projected on the screen to show a scene in which the target a. (for example an airplane) is flying away or otherwise victorious.

In the above described embodiment, a machine gun light emitting ray gun is used to give the shooter a realistic feeling of shooting as the beam is spotlighted against the screen. However, a simple toy gun would also achieve the objects of the present invention. Moreover, the use of a machine gun enables continuous firing so that a hit is determined by the accuracy of aiming and does not need any timing. If, however, a single fire gun is used, an electric gate in the control circuit between the photoelectric element 9 and the solenoids 18 and 19 must be included which is closed by the triggering action of the gun such that a hit occurs only when both the trigger is actuated and the aiming is accurate.

Referring to FIGS. 7 through 10, shown therein is a second embodiment of a shooting game device in accordance with the teachings of the present invention. In the figures is shown a device in which a projector 12*a* is placed in reverse direction with respect to the direction of the projector in the first embodiment of FIG. 1 and the screen 2*a* is placed horizontally. A mirror 33, tilted downward to face the screen 2*a* and a gun 1*a* is provided. As can be seen from FIG. 10, the depth of the game device is greatly reduced thereby making the overall device compact and requiring less floor space.

A switching device 30, for changing the tilt angle of the mirror 33 so as to change the reflecting courses of the beams R1 and R2, is identical to that described in FIGS. 4 through 6 in the first embodiment. The interlocking mechanism for the gun 1*a* and the photoelectric element 9, while almost the same as the first embodiment of FIG. 1, is described hereinbelow in conjunction with FIG. 9.

A support tube 4 is rotatably coupled to a side frame inside a case 34 (not shown). A mounting plate 35, fixed to the upper end of the support tube 4, actually holds the gun 1*a* by means of a shaft 5 disposed through the middle of the gun 1*a*. A moveable frame 36 is axially coupled to the lower end of the support tube 4 by a shaft 37. A protruding detector frame 7 is integrally fixed to the moveable frame 36. A detector 8, having a photoelectric element 9 disposed therein is fixed to the tip of the detector frame 7 and is exposed forward. A connecting rod 11 is disposed vertically and parallel to and in front of a support tube 4. The upper end of connecting rod 11 is coupled to the gun 1*a* and the lower end is coupled to the moveable frame 26 by a shaft 38 such that as the gun 1*a* moves vertically and horizontally the photoelectric element 9 moves vertically and horizontally in an interlocking relationship.

Figure 8:
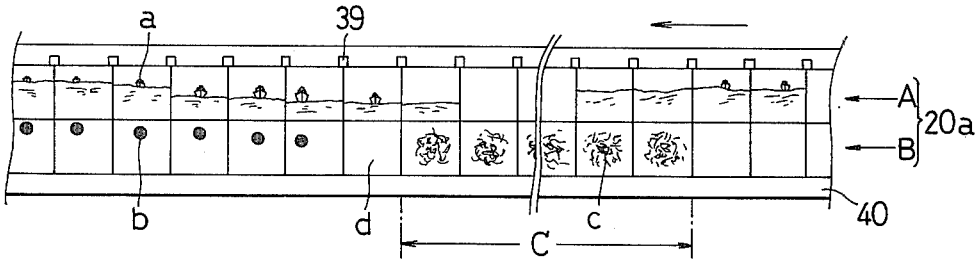
FIG. 8 illustrates the images on the film utilized in the embodiment of FIG. 7.
Figure 9:
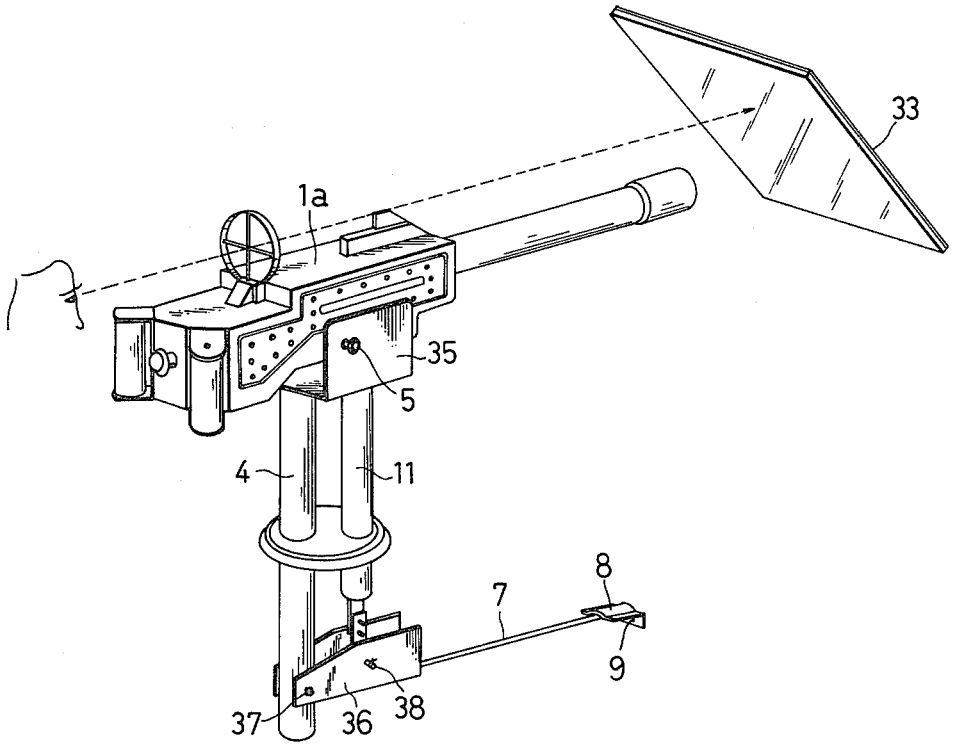
FIG. 9 is a perspective view of an interlocking mechanism for the mirrors and the photoelectric element of the embodiment of FIG. 7.
Figure 10:
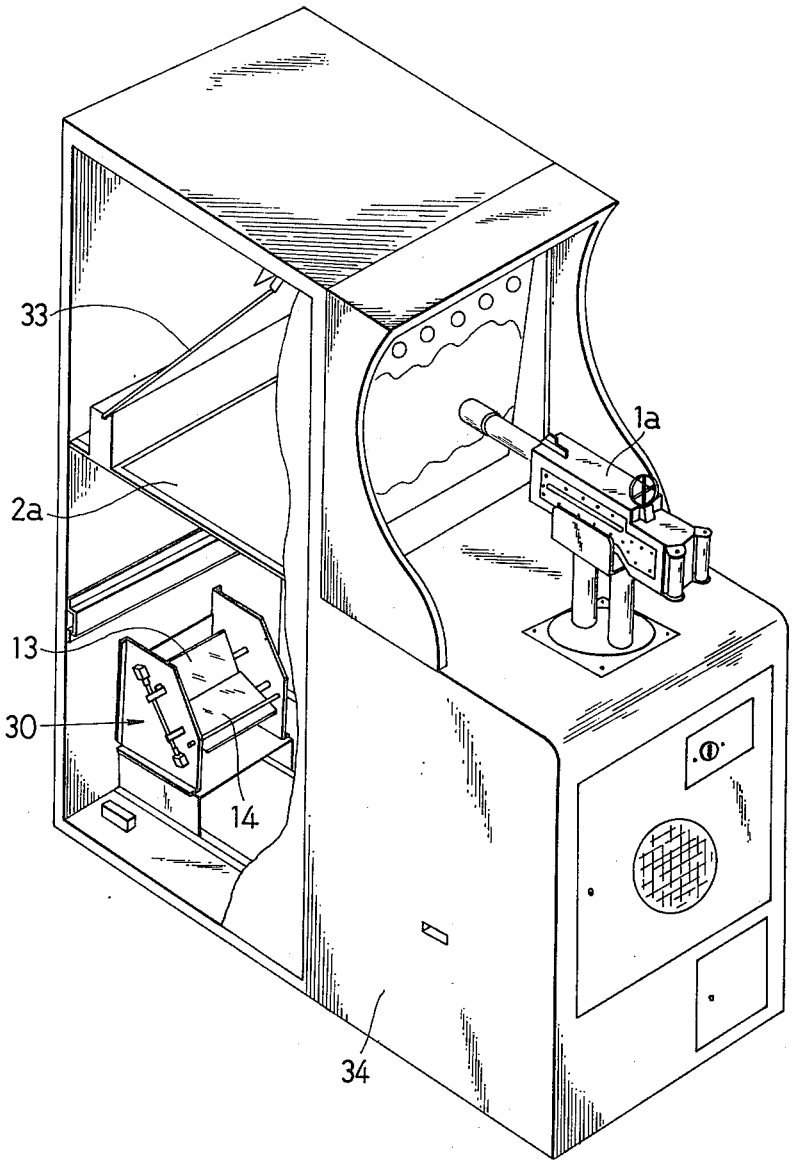
FIG. 10 is a cut-away perspective view of the embodiment of FIG. 7.

While the film 20 of the first embodiment shown in FIG. 2 may be loaded in the projector 12*a* to enact an airplane shooting game, film 20*a* shown in FIG. 8 is used in this second embodiment for a submarine shooting game. The film 20*a* of FIG. 8 is divided into a first track A, (upper half) in which scenes depicting the appearance of a submarine a., a battle, and a disappearing submarine are printed. A second track B (lower half) in which positioning signal marks (transparent spots) b. are printed in corresponding positions to the submarine in each frame of the first track A and, separated by one blank frame d. for generating a switching signal, a display section in which an exploding submarine c. is printed. In FIG. 8, the film includes perforations 39 and a soundtrack 40.

In operation, the photoelectric element 9 moves vertically and horizontally in interlocking relationship with the gun 1*a*. Similarly, the position of the photoelectric element 9 changes as the firing direction of the gun 1*a* against the screen 2 changes. Activation of the projector 12*a* causes the first beam R1 to pass the first track A of the film 20*a* thereby projecting the appearance of a submarine a. on the screen 2*a* and the second beam R2 to pass the positioning signal transparent spot b. in the second track B and project them towards the projector 8.

When the target is hit, the second beam R2 coincides with the photoelectric element 9 and sends out a hit signal. Thereafter, the second beam R2 after passing the blank frame d. enters the photoelectric element 9 which causes the element 9 to send out a positioning signal. The signal activates the switching mechanism 30 to turn the mirrors 13 and 14 to the position shown by the broken lines in FIG. 7 such that the first track A of the film 20*a* is projected off the screen 2*a* while the second track B of the film 20*a* depicting the exploding submarine c. is projected onto the screen 2*a*. The shooter ascertains a hit through the mirror 33.

In the event a hit is not made, a positioning signal is produced in lieu of a hit signal. In order to keep the switching mechanism from activating, the positioning signal controls the activation control circuit in the switching mechanism such that the first track A of the film 20*a* continues to be projected on the screen 2*a* to show the victorious submarine a. leaving the scene. The shooter learns of his failure by means of the mirror 33.

After picking out the blank frame d. in the second track B of the film 20*a*, the photoelectric element 9 picks out the number of revolutions of the shutter 41 as well as the number of frames in the film 20*a* (the shutter 41 is located between the lens 42 and a light source 21 and goes off twice every time the film moves one frame; the photoelectric element 43 picks out the pulse light). The count of the number of frames is sent to a counter. As soon as the counter finishes counting the number of frames in the explosion scene c., the switching mechanism 30 is re-set to project the first track A of the film 20 on the screen 2*a* so as to move into the next shooting sequence.

In practice, just as in the prior embodiment, the control circuitry for this embodiment exists in the prior art and can be constructed from amplifier circuits, relays, etc. which exist in the prior art.

As is apparent from the above description, the shooting game device of the present invention has several advantages over the prior art. These advantages include:

1. The hit detection mechanism is simplified thereby reducing the cost of the shooting game device and making it suitable for general game rooms;

2. Since only a single roll of film divided into two tracks is utilized, the shooting game device is simplified and also insures a simplified hit indication control mechanism; and 3. Since the switching mechanism can quickly switch from the target scene to a hit scene, the player is given a more realistic feeling and a more enjoyable feeling.

In all cases it is understood that the above described embodiments are merely illustrative of but a few of the many possible specific embodiments which represent the applications of the principles of the present invention. Numerous and varied other arrangements can be readily devised by those skilled in the art without departing from the spirit and scope of the present invention.

I claim:

1. A structure for a shooting game device of the type including a means for projecting moving targets and hits onto a screen and a gun having a gun sight and in which when the gun sight corresponds with the projected moving target a hit is projected onto said screen, said structure being characterized by:

a photoelectric element coupled to said gun such that it moves vertically and horizontally as the gun moves vertically and horizontally; and a means for projecting a light mark in near proximity to said photoelectric element which is indicative of a position of a projected target on said screen, said means for projecting a light mark and said photoelectric element being arranged and configured such that when said light mark and said photoelectric element coincide, said photoelectric element generates a hit signal which causes a hit to be projected on said screen in lieu of said moving target, said means for projecting a light mark together with said means for projecting moving targets and hits comprising a projector having film disposed therein, each frame of said film being divided into a A track and a B track, said A track containing images for projecting said moving target in various stages of movement, said B track containing, at corresponding positions with said moving target, positioning signal marks for generating a light mark for acting upon said photoelectric element and images for projecting said moving targets in various stages of destruction and a first beam of light for displaying said moving target passing through said A track of said film and a second beam of light for displaying either a light mark or a hit scene passing through said B track whereby said moving target and said light mark or hit scene simultaneously projected from said projector.

2. A shooting game device using a gun to shoot a target projected onto a screen comprising:

a projector for projecting a first beam of light and a second beam of light, said first beam of light being projected onto said screen to project a display of a moving target upon said screen, said second beam of light being projected towards a detector surface containing a photoelectric element so as to move about on the surface of said detector in a corresponding relationship with the position of said moving target on said screen, said projector comprising:

a first mirror for reflecting said first beam of light;

a second mirror for reflecting said second beam of light; and a switching mechanism for changing the tilt angle of said mirrors, said switching mechanism being arranged and configured such that it ordinarily causes said first mirror to face said screen and said second mirror to face the surface of said detector containing said photoelectric element and causes said first mirror to rotate to a non-opposing position with respect to said screen and said second mirror to face the screen when said photoelectric element coincides with said positioning signal mark whereby said first beam of light is ordinarily projected towards the screen but said second beam of light is projected towards the screen when a hit occurs; and a means for interlocking horizontal and vertical motion of said gun with horizontal and vertical motion of said photoelectric element such that when the fire from said gun hits said shooting target on said screen the position of said actual target illuminated by said second beam of light is coincident with the position of said photoelectric element in said detector whereupon a hit signal is generated by said photoelectric element.

3. A shooting game device according to claim 2, wherein said film further comprises a section on said B track for generating a switching signal provided in between said positioning signal marks and said images for displaying a hit scene.

4. A shooting game device according to claim 2 wherein said switching mechanism includes solenoids for changing the tilt angles of said mirrors.

* * * * *